US005707228A

United States Patent [19]

Lee

[11] Patent Number: 5,707,228

[45] Date of Patent: Jan. 13, 1998

[54] HEAT TREATMENT MACHINE HAVING A COOLING CHAMBER

[75] Inventor: Doo Hwan Lee, Ulsan, Rep. of Korea

[73] Assignee: Hyundai Motor Company, Seoul, Rep. of Korea

[21] Appl. No.: 708,487

[22] Filed: Sep. 5, 1996

[30] Foreign Application Priority Data

Sep. 6, 1995 [KR] Rep. of Korea ..... 95-29126

[51] Int. Cl.[6] ..... F27D 15/02

[52] U.S. Cl. ..... 432/77; 432/5; 432/11; 432/203; 432/205

[58] Field of Search ..... 432/241, 5, 6, 432/11, 203, 205, 77

[56] References Cited

U.S. PATENT DOCUMENTS 3,972,513 8/1976 Mobius et al. ..... 266/130
4,086,050 4/1978 Luiten et al. ..... 432/205
4,955,808 9/1990 Miyagawa ..... 432/6
5,207,573 5/1993 Miyagi et al. ..... 432/241
5,575,083 11/1996 Lee et al. ..... 34/255

*Primary Examiner*—Henry A. Bennett
*Assistant Examiner*—Jiping Lu
*Attorney, Agent, or Firm*—Finnegan, Henderson, Farabow, Garrett & Dunner, L.L.P.

[57] ABSTRACT

The present invention relates to a heat treatment machine for laboratory use which has a cooling chamber incorporated with a heating chamber of a furnace, both chambers are formed with a vacuum tube of simple construction, in which heating and cooling of a test piece are performed in vacuum atmosphere. The cooling process can be effected following the heating process with maintaining the same vacuum atmosphere, whereby a rapid cooling of the test piece is allowed and physical characteristics of the treated metal can be improved.

5 Claims, 2 Drawing Sheets

HEAT TREATMENT MACHINE HAVING A COOLING CHAMBER

BACKGROUND OF THE INVENTION

1. Field of the Invention

The present invention relates to a heat treatment machine for laboratory use and, more particularly, to a sintering and heating machine having a cooling chamber incorporated with a heating chamber of a furnace, both chambers are formed with a vacuum tube of simple construction, in which heating and cooling of a test piece are performed in vacuum atmosphere to improve physical characteristics of treated metal.

2. Description of the Prior Art

Generally, the sintering and heating machines for laboratory use is not furnished with a cooling chamber. Thus, if a sintering or heating of a test metal piece has finished, there remains lots of difficulties in controlling physical characteristics of the metal, which primarily depends on the cooling speed.

It would be a remedy to provide a separate cooling chamber or tunnel outside of the heating chamber, however, in this case, there is a burden of cost for the additional chamber and when the cooling is performed, maintaining of high vacuum is difficult and most cases it exhibits slow cooling speed and low efficiency since a gas cooling method is used. On the other hand, a conventional heat treatment machine for oil or gas quenching, used in the factory, has a cooling chamber as schematically shown in FIG. 2. The heat treatment machine comprises a heating chamber 30, a cooling chamber 31, a moving means 32 for moving metal from heating zone to cooling zone, and vice versa, of each chamber, and a vacuum pumps 33 for vacuumizing the heating chamber and cooling chamber.

Although the conventional large heat treatment machine is fully automatic and most effective in the field, it is not adequate to use in laboratory because of its sophisticated structure and high cost.

SUMMARY OF THE INVENTION

The object of the present invention to provide a laboratory use heat treatment machine which has a cooling chamber incorporated with the heating chamber of a vacuum furnace in a simple manner and which is able to control cooling speed of the heat treated metal.

In achieving the above object, the present invention resides in a heat treatment machine comprising; a heating chamber for heating test piece to the predetermined temperature during a time period; a first extending tube extending horizontally from said heating chamber to a coupling flange provided at the outer end thereof; a second extending tube having a predetermined length and same diameter as that of the first extending tube for communicating with the first extending tube; a cooling chamber coupled with a branch tube of the second extending tube by a flange coupling, and extended downwardly from the bottom of the second extending tube, and having a cooling tank provided around the cooling chamber at a predetermined depth; a moving means provided on the top wall of the second extending tube for moving the test piece from the heating zone of the heating chamber to the cooling zone of the cooling chamber; a vacuum pump means for maintaining the heating chamber and the cooling chamber in a vacuum atmosphere; and a vacuum control means for sensing vacuum level of each chamber and controlling operation of the vacuum pump means in response to the level of vacuum.

In a preferred embodiment of this invention, a cooling water tube is wound around the outer end region of the heating chamber at a predetermined turn for preventing the burning of an air-tight O-ring inserted in the coupling flange. Further, the moving means includes a outer magnet slidably mounted along the outer surface of the extending tube, a inner magnet mounted to face the outer magnet within the inner wall of the tube, a loader for containing the test piece, and a wire rope connected between the inner magnet and the test piece loader.

Advantageously, the cooling process can be effected following the heating process with maintaining the same vacuum atmosphere in each chamber.

BRIEF DESCRIPTION OF THE DRAWINGS

The above object and features of the present invention will become more apparent by describing in detail the preferred embodiment of the present invention with reference to the attached drawings in which.

DETAILED DESCRIPTION OF THE PREFERRED EMBODIMENT

Figure 1:
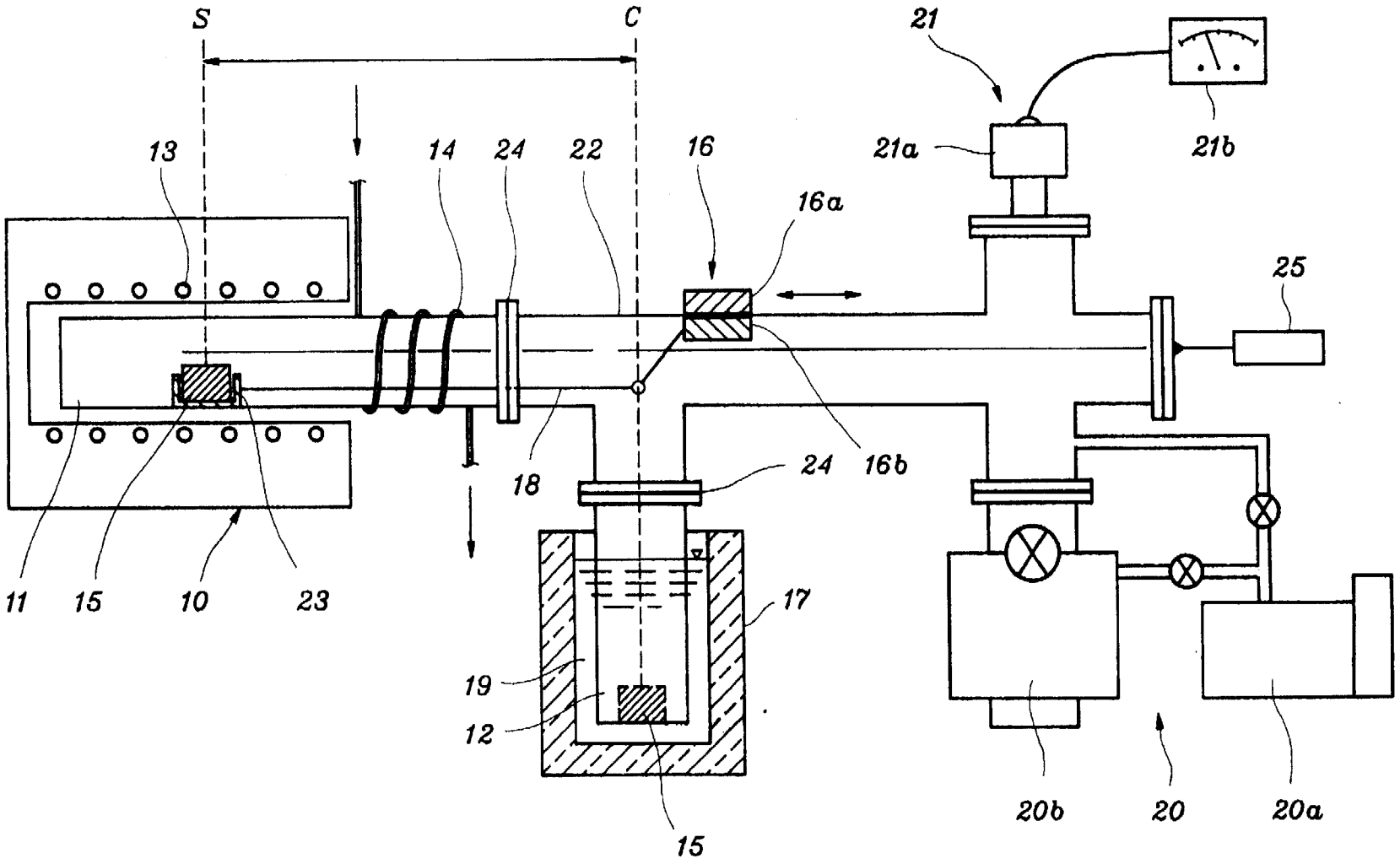
FIG. 1 is an elevation partly in section for illustrating heat treatment machine in accordance with the present invention.
Figure 2:
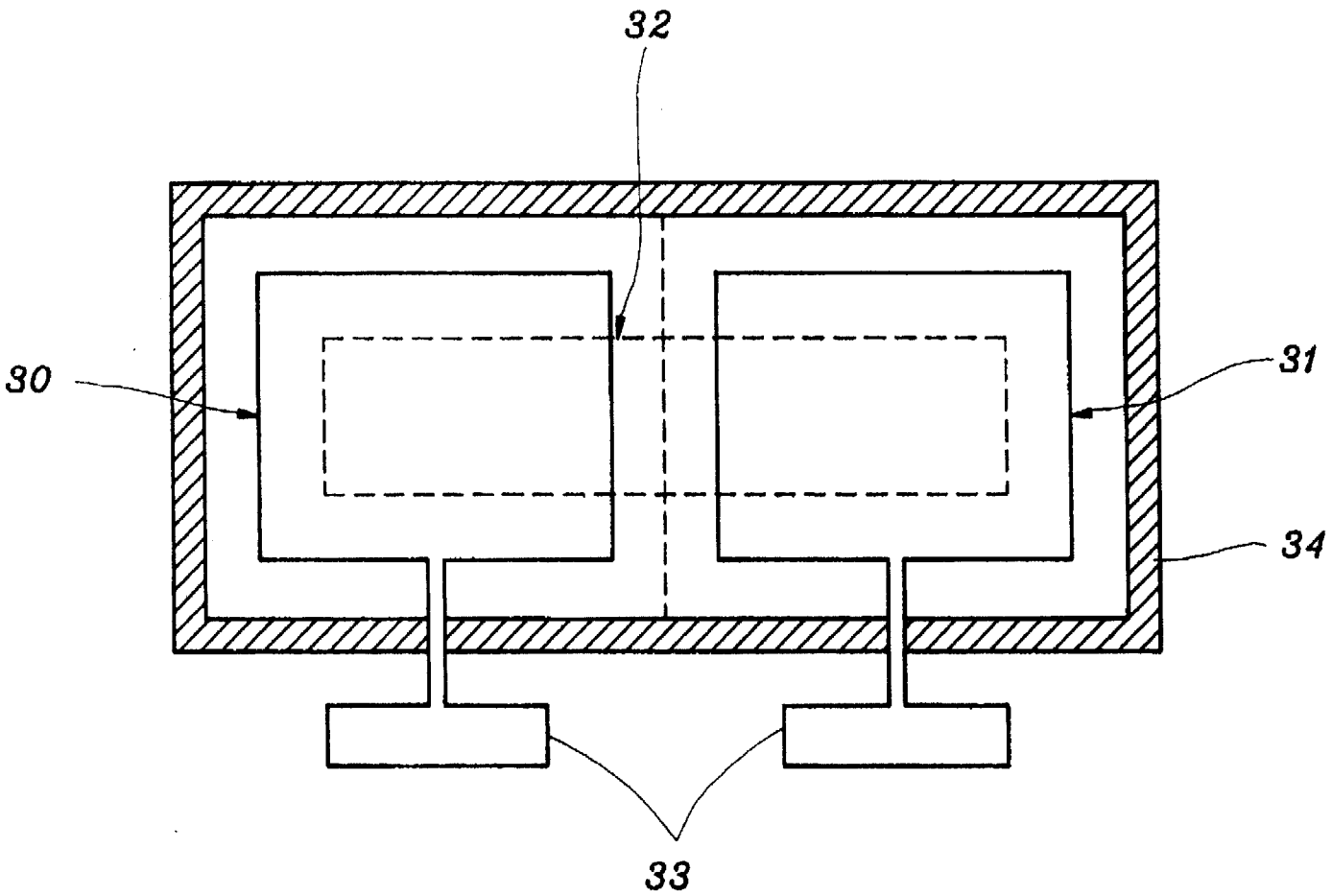
FIG. 2 is a schematic representation of a conventional large size heat treatment machine.

Referring to FIG. 1, there is shown a heat treatment machine for use in a laboratory in accordance with the present invention. The heat treatment machine includes an electric vacuum furnace 10 of a typical form in which a electric heater coil 13 is wound around a heating chamber 11. The heating chamber 11 is a tubular form having a door (not shown) which permits a test piece to be charged into the chamber 11 and placed on a test piece loader 23.

The heating chamber 11 is extended horizontally to the exterior of the furnace 10 at a predetermined distance. The outer end of the extended chamber or tube is formed with a flange 24 to be coupled with a extending tube 22 of the same diameter as that of the heating chamber 11, and around the outer end region of the heating chamber a cooling water tube 14 is wound at a predetermined turn.

The extending tube 22 has a branch tube with which a cooling chamber 12 is connected, by flange coupling, to be extended downwardly from the bottom of the extending tube 22. Also, a cooling tank 17 is provided around the cooling chamber 12 to have a predetermined depth. A refrigerant 19 is received between the inner surface of the cooling tank 17 and the outer surface of the cooling chamber 12. Thus, the cooling chamber 12 is a preferred form of container having open top end and being sunk in the cooling tank 17.

Further, the another end of the extending tube 22 is coupled with a vacuum pump means 20, a vacuum control means 21, and a temperature sensing means 25 by means of appropriate branch tube and flanges, and these components will be described in detail hereinafter.

By this arrangement, the heating chamber 11, the cooling chamber 12, and the extending tube 22 are provided in communication relationship with each other.

Further, the extending tube 22 has a test piece moving means 16 on the top wall thereof. The test piece moving means 16 includes a outer magnet **16*a* slidable along the outer surface of the extending tube 22 by using a guide means, a inner magnet 16*b* facing the outer magnet 16*a* within the inner wall of the tube 22 to move with the outer magnet 16a, a test piece loader 23, and a wire rope 18 connected between the inner magnet 16b and the test piece loader 23 for moving the test piece 15 from the heating zone of the heating chamber 11 to the cooling zone of the cooling chamber 12**.

The vacuum pump means 20 includes a rotary pump 20a for vacuumizing the heating chamber 11 and the cooling chamber 12 to be in a relatively low vacuum level, and a diffusion pump 20b for maintaining the chambers 11, 12 to be in a relatively high vacuum level.

Also, the vacuum control means 21 includes a vacuum sensor 21a for sensing degree of vacuum in the chambers, and a vacuum gauge 21b for controlling operation of the vacuum pump means 20 in response to the output of the vacuum sensor 21a.

With this arrangement, when the test piece 15 is charged into the heating chamber 11, the vacuum pump means 20 is operated to vacuumize the chamber, and the heater coil 13 is supplied with appropriate electric power to heat the vacuum chamber 11 located within the furnace 10. The test piece 15 is heated to the predetermined temperature and the heat treatment is carried out for the predetermined time period. During the heating process, the heat transferred to the outer portion of the extended heating chamber 11 adjacent to the coupling flange 24 is lowered by flowing of the cooling water through the tube 14, thereby preventing the burning of an air-tight O-ring inserted in the flange 24.

On completing the heat treatment, the test piece 15 is immediately pulled by the moving means 16 from the heating zone S in the heating chamber 11 to the cooling zone C of the cooling chamber 12. When the moving means 16 slides along the outer surface of the extending tube 22 far from the flange 24, the test piece 15 contained in the loader 23 moves to the cooling zone of the extending tube 22, at which the test piece 15 is hung and dropped to the bottom of the cooling chamber 12.

The cooling speed of the test piece 15 at the cooling chamber 12 can be controlled by selecting a proper refrigerant to be contained in the cooling tank 17. Thus, a rapid cooling of the test piece is allowable in the cooling process under the vacuum atmosphere.

When the cooling of the test piece 15 is completed, the vacuum pump 20 stops to permit the above vacuum tube to be in the atmospheric pressure. After vacuum off process, the moving means 16 wound up the wire rope 18 to take out the test piece 15 from the cooling chamber 12 and to move it to the location of the discharge door.

As will be apparent from the foregoing description, the heat treatment apparatus of the present invention has following advantages:

1) improve physical characteristics of metal surface for maintaining high vacuum atmosphere in the chambers during the heating and cooling process.
2) Cooling speed of the test piece at the cooling chamber can be controlled by selecting a proper refrigerant to be contained in the cooling tank 17. Thus, a rapid cooling of the test piece is allowed.
3) No need of additional provision of a cooling machine and cost saving for the cooling process.

What is claimed is:

1. A heat treatment machine comprising:

a heating chamber for heating test piece to the predetermined temperature during a time period;

a first extending tube extending horizontally from said heating chamber to a coupling flange provided at the outer end thereof;

a second extending tube having a predetermined length and same diameter as that of the first extending tube for communicating with the first extending tube;

a cooling chamber coupled with a branch tube of the second extending tube by a flange coupling, and extended downwardly from the bottom of the second extending tube, and having a cooling tank provided around the cooling chamber at a predetermined depth;

a moving means provided on the top wall of the second extending tube for moving the test piece from the heating zone of the heating chamber to the cooling zone of the cooling chamber;

a vacuum pump means for maintaining the heating chamber and the cooling chamber in a vacuum atmosphere; and a vacuum control means for sensing vacuum level of each chamber and controlling operation of the vacuum pump means in response to the level of vacuum.

2. A heat treatment machine of claim 1, further comprising a cooling water tube wound around the outer end region of the heating chamber at a predetermined turn for preventing the burning of an air-tight O-ring inserted in the coupling flange.

3. The heat treatment machine of claim 1, wherein the moving means includes a outer magnet slidably mounted along the outer surface of the extending tube, a inner magnet mounted to face the outer magnet within the inner wall of the tube, a loader for containing the test piece, and a wire rope connected between the inner magnet and the test piece loader.

4. The heat treatment machine of claim 1, wherein a refrigerant is received between the inner surface of the cooling tank and the outer surface of the cooling chamber.

5. The heat treatment machine of claim 1, wherein the vacuum pump means includes a rotary pump for vacuumizing the heating chamber and the cooling chamber to be in a relatively low vacuum level, and a diffusion pump for maintaining the chambers to be in a relatively high vacuum level.

* * * * *